United States Patent [19]

Probsteder

[11] 4,281,603

[45] Aug. 4, 1981

[54] MEANS FOR FEEDING SOLID COMBUSTIBLE WASTE MATERIAL TO A FURNACE

[76] Inventor: Josef Probsteder, Bachanger 14, 8399 Ruhstorf, Fed. Rep. of Germany

[21] Appl. No.: 39,453

[22] Filed: May 16, 1979

[30] Foreign Application Priority Data

May 18, 1978 [DE] Fed. Rep. of Germany ..... 2821767

[51] Int. Cl.[3] ..... F23B 7/00

[52] U.S. Cl. ..... 110/196; 110/255; 110/109

[58] Field of Search ..... 110/186, 190, 196, 197, 110/210, 214, 222, 102, 109, 110, 235, 255, 257; 431/346

[56] References Cited

U.S. PATENT DOCUMENTS

| | | | |
|---|---|---|---|
| 847,391 | 3/1907 | Woodmansee | 110/196 |
| 1,758,146 | 5/1930 | Cross | 110/190 |
| 3,570,421 | 3/1971 | Flowers | 110/255 |
| 3,855,950 | 12/1974 | Hughes et al. | 110/186 |
| 3,964,406 | 6/1976 | Partridge et al. | 110/210 |

FOREIGN PATENT DOCUMENTS 979 of 1873 United Kingdom ..... 110/196

*Primary Examiner*—James J. Gill

*Attorney, Agent, or Firm*—Stevens, Davis, Miller & Mosher

[57] ABSTRACT

A furnace for burning solid waste material such as straw bales or wood shavings is fed automatically from a reservoir container through a pipe that leads into the bottom of the furnaces combustion chamber. The automatic feed may comprise a pusher sliding in the pipe under the action of a ram, or an auger. In either case, the pusher or auger largely blocks the pipe to prevent unwanted entry of air into the combustion chamber. The pusher is controlled by an element which senses flue temperature. The container outlet may include a ripping chain to break down the material and the pipe may include a fire extinguishing connection controlled by a heat sensor. The furnace is adapted for admitting controlled quantities of primary air and the hot incompletely burned gases of combustion pass to an afterburning chamber where secondary air is admitted.

5 Claims, 3 Drawing Figures

MEANS FOR FEEDING SOLID COMBUSTIBLE WASTE MATERIAL TO A FURNACE

This invention relates to a device for feeding combustible material to a stove or furnace particularly well suited for feeding combustible waste material from a container thereof to the combustion chamber or fire box of a furnace.

A device of this type used for feeding cocoa bean husks to a furnace are already known from German Gebrauchsmuster No. 66 00 441. In this construction, a delivery screw conveyor is arranged at the outlet opening of a reservoir container for the fuel and it feeds the fuel to a pipe which opens into the top of the combustion chamber of the furnace. The fuel is fed into the pipe pneumatically, and the air required for feeding serves simultaneously as the air for combustion. However, this means that the quantity of air fed to the combustion space of the furnace is far more than would be required for complete combustion and for optimum heat output of the furnace.

This drawback of excessive air applies in particular to furnaces of the kind designed so that, in the combustion space, the fuel is at first only partially burned, so that it forms low temperature gases produced by carbonization, whereupon the low temperature gases are subsequently fully burned with the use of secondary air in an after-burning chamber. Such a furnace, designed for burning large round bales of straw, is disclosed in my German patent application No. 18754/78. It comprises substantially a cylinder, in the upper part of which there is a feed chute which can be closed by a cover and in the lower part of which there are the combustion space and an after-burning chamber. In addition, a sliding plate is provided to separate the feed chute from the combustion space. To feed the fuel in continuously, the cover of the feed chute, to which has been fed a large round bale of straw, is closed whereupon the sliding plate is opened to allow the bale to drop into the combustion space. When the plate has been closed again and the cover has been opened, an additional bale can be put into the feed chute. One drawback of this furnace is that it needs to be fed from time to time by an operator.

Figure 1:
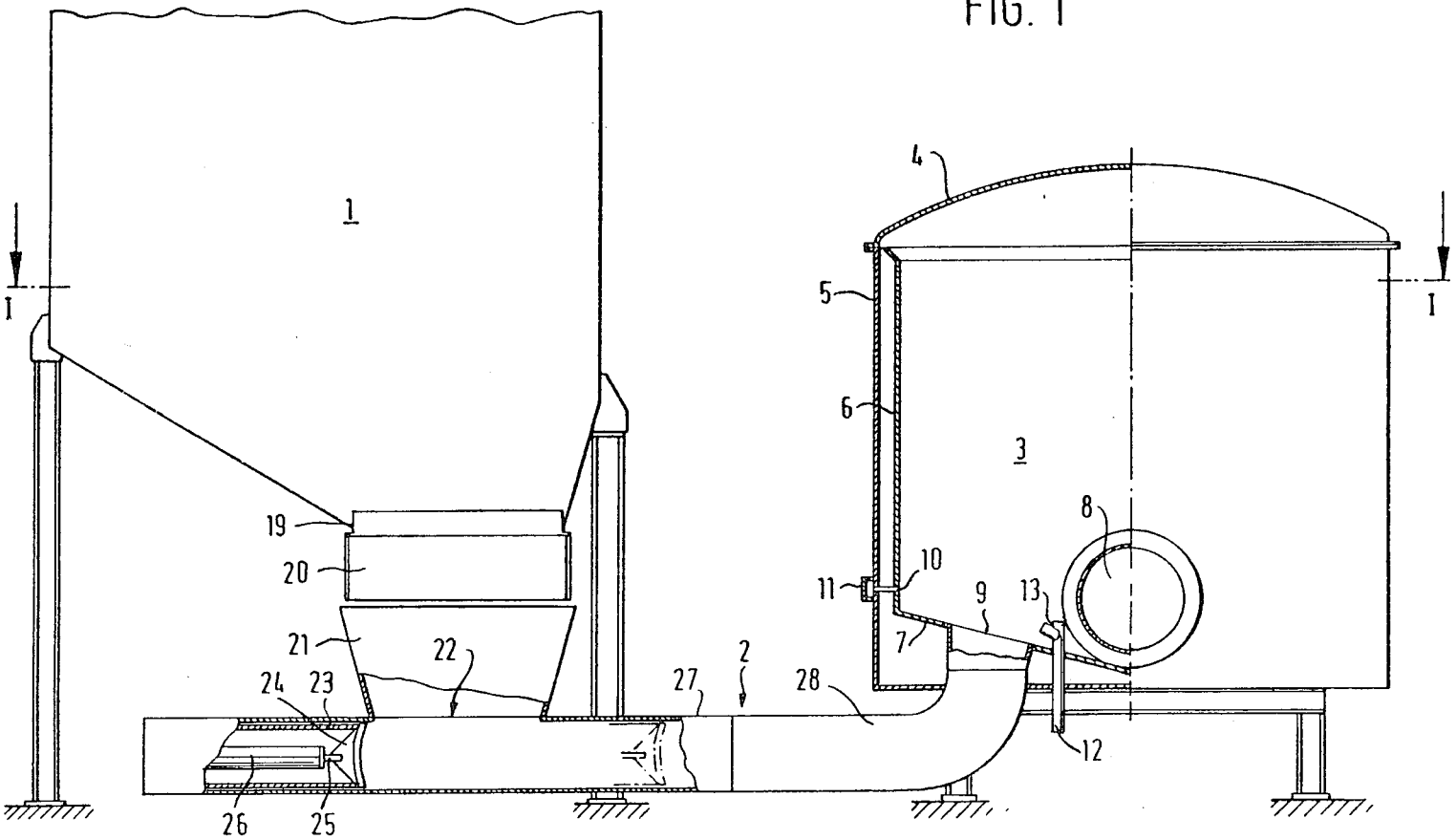
Figure 2:
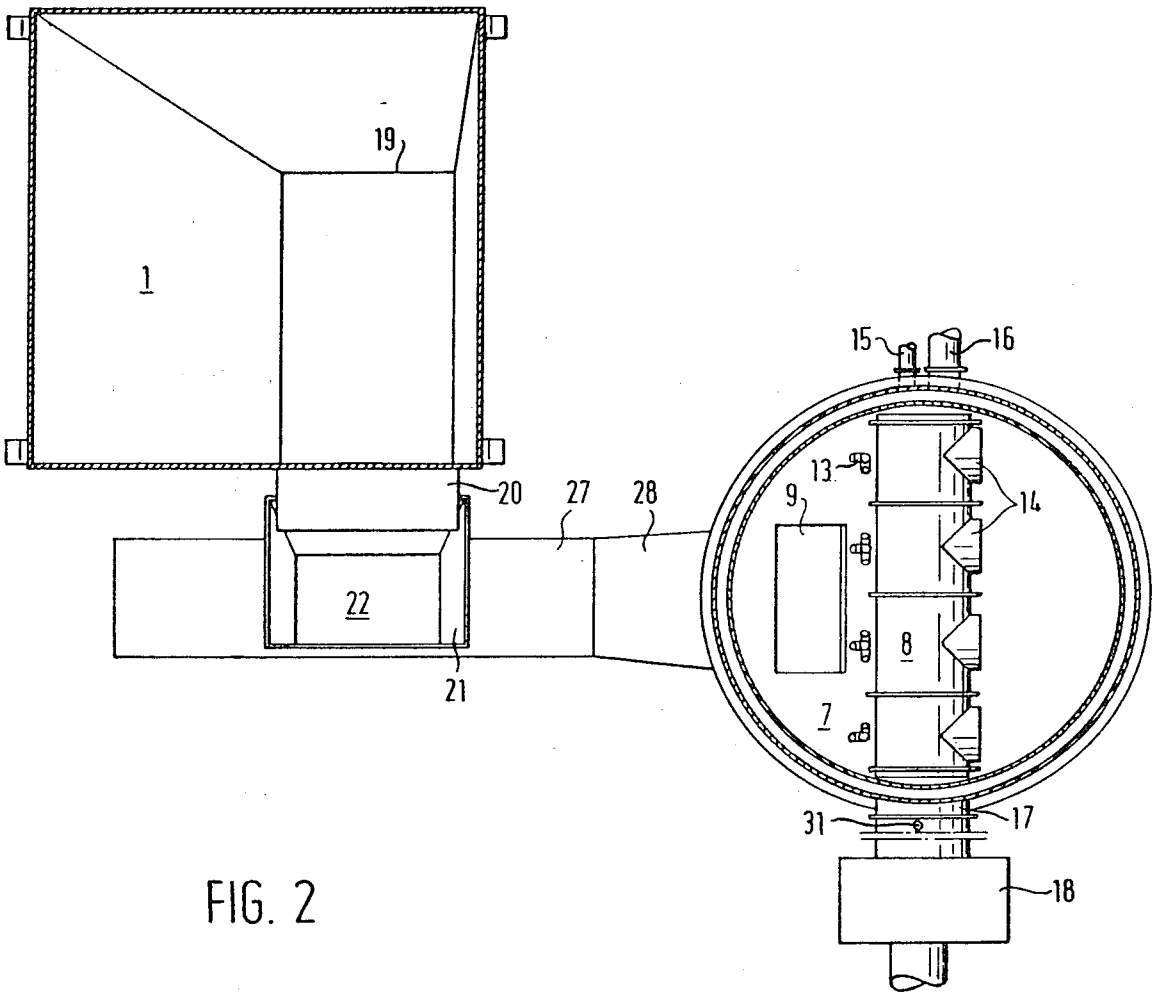
Figure 3:
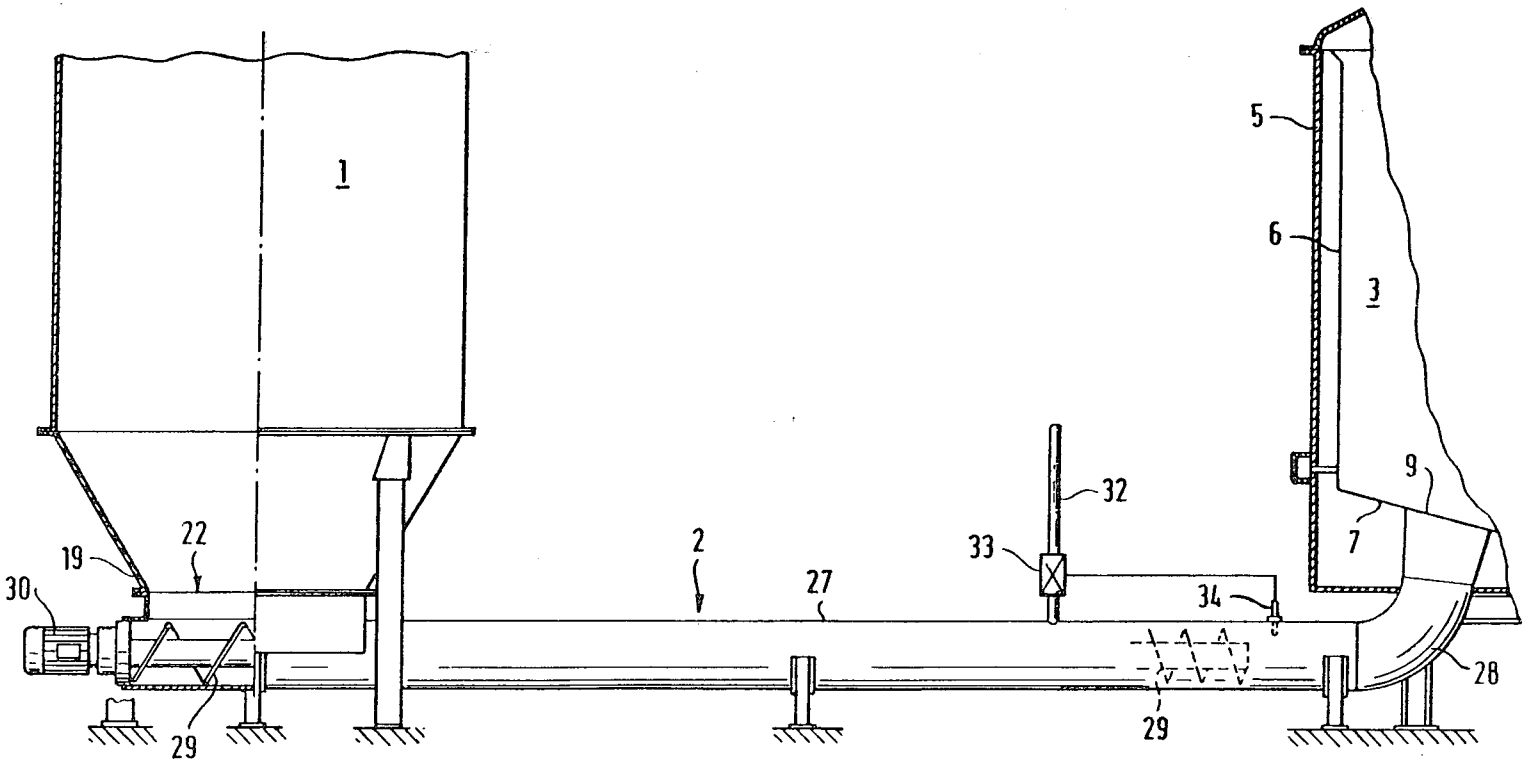

An object of this invention is to improve upon the above described prior air feeding means so that the furnace can operate completely automatically and at the same time with optimum heat output. Other objects will become apparent from the following description with reference to the accompanying drawing wherein FIG. 1 is a side elevation of a furnace with parts broken away, the fuel feeding means being formed by a reciprocating pusher;

FIG. 2 is a section through the furnace along the line I—I in FIG. 1; and FIG. 3 is a side elevation of a furnace with parts broken away, the fuel feeding means being in the form of a screw conveyor.

The foregoing objects and others are accomplished in accordance with this invention, generally speaking, by providing an apparatus for feeding solid combustible waste materials from a reservoir container through a pipe to the combustion chamber of a furnace in which the fuel feeding means substantially prevents the passage of air through the pipe to the combustion chamber and in which the pipe opens into the combustion chamber at the bottom thereof.

The fuel reservoir container is mounted separately from the combustion space and can have a sufficient capacity for the fuel consumed by the furnace over several hours, or indeed days. By virtue of the fuel feeding device being arranged in the pipe and substantially closing the pipe, the air for combustion only reaches the combustion space through separate means provided for the purpose and accordingly the quantity of air can be regulated to be only that quantity which is necessary for complete combustion, or for partial combustion.

At the same time, the operating security essential for fully automatic operation is achieved because any tendency for the combustion process to spread out of the combustion space and into the pipe is discouraged by the lack of oxygen in the pipe.

With the same object in mind, the pipe opens into the combustion space from below rather than above. In fact, for combustion to occur, not only oxygen, but also the presence of a predetermined ignition temperature is necessary. However, by virtue of the fact that the pipe opens into the bottom of the combustion space the penetration of hot gases from the combustion space into the pipe, although not wholly impossible, is at the same time made so difficult that the fuel in the pipe is prevented from reaching its ignition temperature.

The furnace illustrated in the drawing has a storage reservoir container 1 connected through a pipe 2 to a combustion chamber 3 which is formed by a cylindrical housing 5 closed by a cover member 4 so that a space for insulation is formed between the side wall 6 and floor 7 of the combustion chamber 3 and the side wall and floor of the cylinder.

An after-burning chamber 8 in the form of a pipe extends transversely through the combustion chamber 3 above the level of the floor 7. That half of the floor 7 into which the pipe 2 opens through a rectangular opening 9 is inclined downwards towards the center of the floor 7. A door, not shown, is provided in the side wall 6 of the combustion chamber 3 above the floor 7 and near the opening 9.

Primary air for combustion is fed to the combustion chamber 3 through openings 10 in its side wall 6. For this purpose, the openings 10 are connected together by a ring main conduit 11 arranged around the outside of the housing 5. In addition, primary air for combustion reaches the chamber 3 through a number of pipes 12 passing through the floor 7 of the chamber 3. The pipes 12 are equipped with distributing heads 13 arranged between the opening 9 and the after-burning chamber 8. The ring conduit 11 and the pipes 12 are connected to a source of compressed air, not shown, for example, a compressor.

The low-temperature partially burned gases produced in the chamber 3 pass into the after-burning chamber 8 through pipe stubs 14 of which the mouths lie on the opposite side of the chamber 8 from the opening 9. The secondary air necessary for burning the low-temperature partially burned gases is fed into the chamber 8 through a pipe 15 at one end of the chamber 8, if necessary making use of the above-mentioned source of compressed air. Also, on this end face there is a pipe stub 16 allowing access to the chamber 8 for cleaning or inspection.

A flue pipe 17 is connected to the other end face of the after-burning chamber 8 and it leads to a heat exchanger 18. The gases of combustion, cooled in this way, are drawn on by a fan, not shown.

The furnace ilustrated in FIGS. 1 and 2 is designed in particular for burning large round bales of straw. For this purpose, the storage container 1 terminates at its bottom end in an outlet opening 19 equipped with a so-called ripping chain 20 which is in the form of an endless moving belt provided externally with ripping teeth. The action of the chain 20 converts the bales into loose straw again and delivers it to a funnel 21 above an inlet 22 leading to the pipe 2.

A pusher 23 is guided at the inlet 22 of the pipe 2 to reciprocate longitudinally with respect to that pipe. The pusher 23 is formed by a hollow cylinder closed by an end face of which the outer surface is concave. The length of the pusher 23 is greater than that of the inlet 22 looking in the direction along the pipe 2. The pusher 23 is secured to the piston rod 25 of a hydraulic ram 26 by attachment means 24.

In the one end position of the pusher 23, shown in FIG. 1, in which it is on the left of the inlet 22 and which is illustrated in full lines, i.e., in which the piston rod 25 is retracted into the ram 26, combustible material can enter the pipe 2 from the container 1 through the ripping chain 20, the funnel 21 and the inlet 22. When the piston rod 25 is advanced, this combustible material is then forced by the pusher 23 through the pipe 2 and into the combustion chamber 3 until the pusher 23 has reached its other end position at the right hand end of the inlet 22, as illustrated in broken lines. As the outer profile of of the pusher 23 matches the internal profile of the pipe 2, at least over the portion 27, it simultaneously acts to prevent any significant quantity of air from the inlet 22 passing through the pipe 2 into the combustion chamber 3. The pusher is long enough so that, when it is in its right-hand end position, its tail stretches back at least to the right-hand end of the inlet 22.

Joined to the portion 27 of the pipe 2 nearest the inlet 22, which portion is straight, is an upwardly curved knee-shaped portion 28 which terminates at the opening 9 in the floor 7 of the combustion chamber 3. The portion 28 widens out towards the opening 9, as shown in particular in FIG. 2. This prevents the portion 28 of the pipe 2, which is not reached by the piston 23 becoming blocked.

The furnace illustrated in FIG. 3 differs from that of FIGS. 1 and 2 substantially in that in place of the pusher 23 and ram 26, there is a screw conveyor or auger 29 extending from the inlet 22 into the pipe 2, and furthermore the ripping chain 20 is omitted and instead the outlet opening 19 of the container 1 is arranged directly above the inlet 22. Long-fiber combustible material such as loose straw is difficult to handle by a screw conveyor so, in contrast to the furnace of FIGS. 1 and 2, the furnace shown in FIG. 3 is adapted primarily for small-particle combustible waste materials such as wood shavings, sawdust, bark, corn fibers or powdered straw.

The screw conveyor of auger 29 is driven by an electric motor 30. It extends almost up to the knee-shaped portion 28 of the pipe 2 and, on account of its substantial length, necessary to prevent air flow through the pipe 2 to the combustion chamber 3, it is guided by longitudinally extended metal strips, not shown, secured to the inner surface of the portion 27 of the pipe 2.

Mounted on the flue pipe 17 between the after-burning chamber 8 and the heat exchanger 18, there is a temperature sensing elements 31 which, when a predetermined minimum temperature of the gases of combustion is reached, acts through means not shown to set in motion the ram 26 of the pusher 23 and the motor for driving the ripping chain 20 or the electric motor 30 driving the conveyor 29.

Also connected to the pipe 2 is a pipe 32 for an extinguishing medium, illustrated only in FIG. 3 but equally applicable to the furnace of FIGS. 1 and 2. The pipe 32 is normally closed off by a valve 33 connected to a temperature-sensitive element 34 on the pipe 2. In the event of the combustion spreading from the combustion chamber 3 into the pipe 2 as a result of some kind of disturbance or failure in operation, the valve 33 is opened by the element 34 and thereby extinguishes any fire in the pipe 2 before it can spread to the container 1.

The furnace operates as follows, the description being confined, in the interests of simplicity, to the furnace of FIGS. 1 and 2.

The quantity of combustible material necessary for the desired period of operation is fed into the reservoir container or bin 1, for example the required number of large round bales of straw. Then the ripping chain 20 is set in operation, as well as the ram 26. The loose combustible material, for example straw, thus falling through the funnel 21 and the inlet 22 into the pipe 2, is pushed to the right, by the pusher 23, towards the combustion chamber though a distance corresponding to the stroke of the pusher 23. When the pusher 23 retracts away from the chamber 3 into its left-hand end position, to the left of the inlet 22, the inlet is uncovered and further loose combustible material reaches the pipe 2 through the funnel 21. The reciprocating movement of the pusher 23 continues automatically until the combustion chamber 3 is loaded with combustible material.

After the combustible material in the chamber 3 has been ignited, primary air for combustion is fed to the chamber 3 through the openings 10 and the pipes 12 and secondary air for combustion is fed to the after-burning chamber 8 through the pipe 15. Also the fan that is connected beyond the heat exchanger 18 is switched on.

This results in a partial combustion or low temperature zone being formed in the combustion chamber 3 at the level of the openings 10 and the distributing heads 13, and combustible gases such as pyrolignite or phenols are driven out of the combustible material. The suction of the fan which is connected beyond the heat exchanger 18 draws these partly burned gases through the pipe stubs 14 into the after-burning chamber 8 where they are fully burned, converting them into carbon dioxide and water vapor. The heat of the fully burned gases is extracted by the heat exchanger 18 and fed to wherever it is to be used.

As soon as the temperature of the gases of combustion in the outlet pipe 17 has reached a predetermined minimum value, the continued operation of the furnace can be automatic, a fall in the temperature to this minimum value being signalled by the temperature-sensitive element 31 to cause the ripping chain 20 to run and to cause the pusher 23 to be set in operation by means of the ram 26 and thereby to deliver further combustible material to the chamber 3.

Although the invention has been described in detail for the purposes of illustration, it is to be understood that such detail is solely for the purpose of illustration and that variations can be made therein without departing from the spirit and scope of the invention except as it may be limited by the claims.

What is claimed is:

1. An apparatus for burning combustible waste material comprising means for storing waste material to be burned comprising an upright elongated housing having a closed top and a bottom closure member which slopes downwardly from the housing, said housing, closed top and bottom closure member combining to substantially enclose a space for storage of waste material, an opening in said bottom member disposed at the lowest point of said sloping bottom member, a discharge pipe communicating with said opening and extending downwardly therefrom for flow of waste material from the said storage space, a furnace for burning said waste material comprising an upright substantially cylindrical housing and top and bottom closure members fixed to the ends of said housing, an upright wall spaced radially inwardly from the housing substantially concentric therewith and extending across the space and integral with said cylindrical housing adjacent to the top closure member, a bottom wall integral with the upright wall, spaced above said bottom closure member and sloping downwardly from said wall towards a point adjacent to the bottom closure member, an opening in said sloping wall, conduit means extending upwardly through said bottom wall into said space for delivering primary air to the said space, a tubular member enclosing an afterburning chamber extending across said space and having a wall with a plurality of openings therein for flow of gases from the said space into the afterburning chamber which face away from the opening in the said bottom wall, means for supplying air to the said chamber, a conduit communicating with said discharge pipe and with said opening in said sloping bottom wall of the furnace, and means for moving waste material through the conduit from the discharge pipe through said opening into the space enclosed by said housing, top closure member and sloping bottom wall, said means for moving the waste material closing said conduit against flow of air from the conduit into said furnace.

2. The means of claim 1, comprising a pusher arranged to reciprocate longitudinally in the pipe and which, in its one end position nearest the combustion chamber closes off the pipe between an inlet to the pipe for the combustible material from the reservoir container and the combustion chamber and in its other end position uncovers the said inlet.

3. The apparatus of claim 2 in which the pusher is in the form of a hollow cylinder which is at least long enough so that in its end position nearest the combustion chamber it extends to that end of the inlet which is furthest the combustion chamber.

4. The appartus of claim 2 or claim 3 in which the pusher is actuated by a fluid-pressure ram.

5. The apparatus of claim 1 wherein a feed pipe for an extinguishing medium having a value, is connected to the first-mentioned pipe through a value actuated by a temperature-sensitive element mounted on the first-mentioned pipe between the combustion chamber and the connection to said feed pipe for an extinguishing medium.

* * * * *